United States Patent [19]

Bandyopadhyay et al.

[11] Patent Number: 4,482,481

[45] Date of Patent: Nov. 13, 1984

[54] METHOD OF PREPARING NUCLEAR WASTES FOR TANSPORTATION AND INTERIM STORAGE

[75] Inventors: Gautam Bandyopadhyay, Naperville; Thomas M. Galvin, Darien, both of Ill.

[73] Assignee: The United States of America as represented by the Department of Energy, Washington, D.C.

[21] Appl. No.: 383,880

[22] Filed: Jun. 1, 1982

[51] Int. Cl.[3] ..... G21F 9/16

[52] U.S. Cl. ..... 252/628

[58] Field of Search ..... 252/628, 629; 106/74, 106/78

[56] References Cited

U.S. PATENT DOCUMENTS

| | | | |
|---|---|---|---|
| 3,498,802 | 3/1970 | Bickford et al. | 106/74 |
| 3,498,803 | 3/1970 | Stookey et al. | 106/74 |
| 3,837,872 | 9/1974 | Conner | 106/74 |
| 3,841,102 | 10/1974 | Cinner et al. | 405/128 |

OTHER PUBLICATIONS

G. Bandyopadhyay et al., "Materials Studies of Simulated Interim Waste Forms for High-Level Radioactive Wastes". Transactions of The American Nuclear Society, vol. 38, 1981.

G. Bandyopadhyay et al., "Solidification of High Level Waste to Interim Forms", a paper to be presented at the 74th Annual Meeting of the Am. Institute of Chemical Engineers, New Orleans, LA, Nov. 8-12, 1981.

G. Bandyopadhyay, "Interim Waste Forms for High--Level Radioactive Wastes: Processing and Properties", proceedings of the Int'l. Symposium on Scientific Basis for Nuclear Waste Management, Steven V. Topp, Ed., Boston, MA, 1981.

Granland, R. W., "Solidification of Low-Level Radioactive Liquid Waste Using a Cement-Silicate Process", paper given at the Health Physics Society Twelfth Midyear Topical Symposium, Low Level Radioactive Waste Management, Wmsburg, VA, Feb. 12-15, 1979.

*The Condensed Chemical Dictionary,* 9th Ed., Van Nostrand Reinhold Co., N.Y. 1977, p. 151.

D. M. Roy et al., *Scientific Basis for Nuclear Waste Management,* vol. 2, Ed. L. J. M. Northrap, Jr., Plenum Press, 1980, pp. 343-349.

*Primary Examiner*—Deborah L. Kyle
*Assistant Examiner*—Virginia B. Caress
*Attorney, Agent, or Firm*—James W. Weinberger; Walter L. Rees; Michael F. Esposito

[57] ABSTRACT

Nuclear waste is formed into a substantially water-insoluble solid for temporary storage and transportation by mixing the calcined waste with at least 10 weight percent powdered anhydrous sodium silicate to form a mixture and subjecting the mixture to a high humidity environment for a period of time sufficient to form cementitious bonds by chemical reaction. The method is suitable for preparing an interim waste form from dried high level radioactive wastes.

12 Claims, No Drawings

METHOD OF PREPARING NUCLEAR WASTES FOR TANSPORTATION AND INTERIM STORAGE

CONTRACTUAL ORIGIN OF THE INVENTION

The United States Government has rights in this invention pursuant to Contract No. W-31-109-ENG-38 between the U.S. Department of Energy and Argonne National Laboratory.

BACKGROUND OF THE INVENTION

The invention relates to a method of converting radioactive waste into a substantially water-insoluble solid form suitable for transportation and temporary or interim storage. More specifically, the invention relates to a method of transforming calcined, high-level radioactive wastes into a water-insoluble solid product suitable for transportation and interim storage.

A typical high-level waste is the result of the neutralization with sodium hydroxide of a highly acidic nuclear fuel waste processing solution such as in the case of reprocessing of irradiated nuclear fuel. The stored waste typically consists of a supernatant liquid layer, which has a high concentration of sodium nitrate and nitrite salts, and a bottom insoluble layer of sludge. The precise composition of the supernatant liquid and the sludge are determined by the fuel and the subsequent processing details. The sludge obtained from reprocessing of fuel may consist largely of iron and aluminum hydroxides. In addition, iron phosphate, nickel and chromium hydroxides, aluminum fluoride, some rare earths, molybdenum phosphate, and manganese, plutonium and uranium oxides may be present in the sludge.

These high-level liquid radioactive wastes are often produced at facilities in which terminal processing of the waste is not practical because the quantities of waste are relatively small and the capitol cost of terminal processing equipment and facilities is high. Current regulations do not permit shipment of high-level liquid wastes. Under these circumstances the waste must be incorporated into an interim solid form for shipment to a terminal processing site. Because the shipment waste form is not expected to remain intact for more than a few years, the criteria for an acceptable interim waste form is not as stringent as that required for geological storage for a final waste form.

Ideally, the interim form should require only simple processing methods, so that extensive additional facilities will not be required at the originating site. Additionally, the interim waste form must satisfy shipping criteria, particularly in relation to transportation accidents. For example, the form must be resistant to impact fracturing and when fractured, should not produce large quantities of fine particles ($<10$ $\mu$m) which could become airborne and spread radioactivity into the environment. Furthermore, the form must be physically and mechanically stable in the ambient environment, should be able to withstand high temperatures without decomposition, should be sufficiently insoluble in water so that, when exposed (e.g. in case of an accident), would allow reasonable time to clean up without extensive loss due to leaching. The interim form should also be compatable with proposed terminal waste forms.

A number of interim forms for handling these high level radioactive wastes have been proposed. The simplest form is a fused-salt/sludge waste form, which is prepared simply by evaporating the water from the supernatent, melting the precipitated salts, slurrying the oxide and hydroxide sludge components into the melted fused salt and freezing the mixture to form cakes of sludge in fused sodium nitrate/nitrite salt. These cakes can then be shipped and redissolved or remelted for terminal processing. This fused-salt waste form has the advantage of simple processing and of allowing simultaneous treatment of the supernatant liquid and of the sludge. Synthetic fused salt/sludge solid samples were found to dissolve very rapidly in stagnant water at ambient temperature. Fused salt samples were also found to be highly hygroscopic. The samples were often partially or completely dissolved in the absorbed moisture, indicating that the waste form must be stored in a dry environment to avoid moisture absorption. The high water solubility and hygroscopicity of the fused salt/-sludge interim waste form make its storage and transportation somewhat difficult. The storage canister must be able to overcome the difficulties of this waste form.

Another proposed form for handling high-level liquid radioactive wastes is the use of cement or concrete as a matrix for interim solidification. However, the primary difficulty of using these compositions (e.g. Portland cement) which often contain oxides of calcium, aluminum and smaller amounts of magnesium and iron, as an interim waste form is the incompatability of the cement or concrete with a terminal waste form such as borosilicate glass, which at present is the terminal waste form most likely to be used.

Still another suggestion is to blend calcined sludge with anhydrous amorphous sodium silicate powder, cold press the blended mixture to pellets, and subsequently sinter the pellets to high density by firing them to approximately 600° C. in air. Anhydrous amorphous sodium silicate (with $SiO_2$:$Na_2O$ ratios of 3.22 and 2.00) powders, in pure form, can easily be sintered to $>90\%$ theoretical density. However, additions of synthetic sludge to sodium silicates were found to substantially reduce sinter density and fracture strength thus deteriorating the properties of the waste form. In addition, the sintering step would require use of a high-temperature furnace which adds substantial complexity to the process.

All of the above described interim waste forms for high-level radioactive waste, have limitations. Either they are incompatable with a proposed terminal waste form, are too soluble in water or require difficult processing steps for fabrication.

SUMMARY OF THE INVENTION

A new interim waste form and method for preparing the same has been developed which overcomes many of the objections to the hereinbefore described waste forms. The new waste form consists of dried and/or calcined high-level radioactive waste sludge disposed in a matrix of silicate with which it forms cementitious bonds. The waste form is prepared by mixing the dried, powdered wastes with at least 10 weight percent powdered anhydrous sodium silicate to form a mixture, the sodium silicate having a $SiO_2$:$Na_2O$ ratio of at least 2:1, and subjecting the mixture to a relative humidity of at least 70% until the mixture becomes saturated with moisture, thereby curing the mixture and forming a solid, substantially water-insoluble waste form for temporary storage and transportation of radioactive wastes. Alternatively, up to 10 weight percent calcium hydroxide may be incorporated into the mixture, before adding the moisture in order to improve on the mechanical strength.

The waste form of the invention is physically and mechanically stable in the ambient environment and in hot fire condition, has greater mechanical strength than any of the other interim waste forms except for concrete and when subjected to impact fracture, produces a very low percentage of fines which might release radioactivity to the environment. Furthermore, the form is very resistant to leaching with water particularly at higher silica ratios.

It is therefore one object of the invention to provide an interim waste form for the transportation and temporary storage of high-level radioactive nuclear wastes. It is another object of the invention to provide an interim waste form which is physically and chemically stable in the ambient environment and in hot fire conditions, is mechanically strong for easy handling, has adequate impact strength, does not produce excessive airborne fines after impact fracture, is substantially water-insoluble and is compatable with terminal waste storage forms such as borosilicate glass. Finally it is the object of the invention to provide a method for preparing an interim waste form for high-level radioactive waste which utilizes sodium silicate and which can be cured at room temperature.

DETAILED DESCRIPTION OF THE INVENTION

These and other objects of the invention may be met by mixing about 75 weight percent high-level radioactive waste calcines with about 25 weight percent anhydrous sodium silicate powder to form a mixture, the sodium silicate having a $SiO_2$:$Na_2O$ ratio of about 3.22, cold pressing the mixture to form a green body having a density of up to 50% of theoretical, and subjecting the green body to a relative humidity of about 90% at a temperature of about 35° C. for a period of time sufficient to absorb enough moisture to form cementitious chemical bonds, thereby curing the mixture and forming a substantially water-insoluble solid.

The interim waste form therefore is a substantially water-insoluble solid consisting of about 75 weight percent high-level radioactive solids dispersed in a matrix of about 25 weight percent silicate with which it forms cementitious bonds.

The anhydrous sodium silicate used to prepare the waste form is present as a fine powder having a U.S. mesh size from about −100 to +325. The sodium silicate preferably has a $SiO_2$:$Na_2O$ ratio between about 4.0:1 to 2.0:1 in order to provide sufficient strength and leach resistance. The higher silica ratios are preferred since they provide increased crushing strength and leach resistance. The mixture must contain at least 10, preferably 25 weight percent sodium silicate in order to provide a solid having adequate strength and leach resistance.

The addition of calcium hydroxide to the mixture may be optional for some waste forms. Often times some of the oxides such as $Fe_2O_3$, NiO, $Cr_2O_3$, $MnO_2$ etc. present in the calcined waste will react with the sodium silicate in the presence of moisture to form silicate bonds that provide the necessary strength and stability of the interim waste form. However calcium hydroxide may be added to the mixture if additional strength of the waste form is required. Additions of up to 10 weight percent calcium hydroxide have been found to be beneficial particularly when an anhydrous sodium nitrate having a low silicate ratio is used.

The high-level radioactive waste should preferably be present as a calcine which consists of a mixture of oxides of various metals found in the sludge, although the waste form may also be prepared from dried sludge. The calcine is present as a powder or granular substance having a U.S. mesh size of at least −25.

The mixture is formed by thoroughly mixing, as dry powders, the radioactive waste, the anhydrous sodium silicate and calcium hydroxide if necessary, to form an intimate mixture. Preferably, the mixture is cold pressed to form a green body. The green body should have a density of no more than 60%, preferably no more than 50% of theoretical in order to allow sufficient porosity for the moisture to enter and react with all of the mixture which forms the body. Alternatively, the mixture may be cured as a powder without cold pressing. A fully cured powder may provide a cohesive body of adequate strength and leach resistance.

Curing is accomplished by exposure to a high humidity environment at room temperature. Preferably the humidity is at least 70% relative, preferably about 90%, so that curing will be completed within a reasonable period of time. The time required to cure the mixture will vary with the density, the surface area of the body and with the percent of humidity present. Curing is completed at such time that the mixture or green body will no longer absorb moisture as determined by a lack of further weight gain. It was found that a green body with about 10 $cm^2$ surface area, with a density of about 50% of theoretical was cured in about 24 hours in a humidity of 90% at 35° C.

Alternatively, curing could be accomplished by adding a predetermined amount of water to the sludge-silicate powders and stirring the resulting mixture to ensure complete dispersion. This will however increase the complexity of the process.

The addition of up to 10 weight percent of a mixture of sodium nitrate and nitrite salts were found to have no detrimental effect on the physical properties of the waste form. This is particularly important should these salts be present in the dried sludge or, as sodium oxides, in the calcined waste.

The waste form of the invention was found to have fracture strength up to at least 3 MPa, depending on composition. Further, when the waste forms were fractured, they produced only about 0.04 to 0.2 weight percent fines.

The reactions that occur during curing of the mixture of anhydrous sodium silicate with waste sludge are extremely complicated. However, it is generally known that sodium silicate will react with any polyvalent metal ions such as are present in the calcined sludge, e.g. iron, chromium, nickel, manganese, etc., and form relatively insoluble silicates. The addition of a calcium salt such as $Ca(OH)_2$, provides for excess divalent ions for reactions with the silicate in case of an insufficient amount of metal ions present in the calcined waste in suitable form for reactions. Curing the samples in high humidity environment provides a simple way to supply moisture to the powder mixture for reactions between silicate and oxides to take place. The cementitious bonds that form during these reactions provide the required strength and stability of the interim waste form.

The following examples are given to illustrate the method of the invention and properties of the interim waste form and are not to be taken as limiting the scope of the invention as identified by the appended claims.

EXAMPLE I

A synthetic calcined waste sludge was prepared having the formula given in Table I.

TABLE I

| Component | Wt % | Component | Wt % |
|---|---|---|---|
| $Fe_2O_3$ | 45.73 | $MnO_2$ | 2.72 |
| $FePO_4$ | 35.23 | $UO_2$ | 7.02 |
| $Cr_2O_3$ | 3.56 | SrO | 0.46 |
| NiO | 1.69 | $RuO_2$ | 0.46 |
| $Nd_2O_3$ | 1.73 | $ZrO_2$ | 1/37 |

Commercially available anhydrous, amorphous sodium silicate powders were blended with as much as 75 weight percent of the synthetic sludge described in Table I. The sodium silicate, supplied by the PQ Corporation, Valley Forge, PA, was designated as SS-65 and SS-C and had $SiO_2$:$Na_2O$ ratios of 3.22 and 2.00 respectively. The powder mixture was cold pressed at 70 MPa to cylindrical pellets in the dimension from 1 to 3 cm diameter and up to 2 cm high. Chemical bonds were then formed by curing the cold pressed samples in 90% relative humidity at 35° C. for 24 hours. In several compositions, 5 weight percent $Ca(OH)_2$ powder was added to form additional cementitious bonds during curing. Five weight percent of a sodium nitrate and nitrate salt was also added to some mixtures in order to study the effect of residual salt in case of incomplete removal of supernatant from the sludge. The results are given in Table II below:

TABLE II

| Composition | | | | | Water | | Fracture |
|---|---|---|---|---|---|---|---|
| Sludge | Silicate | | $Ca(OH)_2$ | Salt | Absorption | Sample | Strength[a] |
| (wt %) | Type | Wt % | (wt %) | (wt %) | (wt %) | Quality | (MPa) |
| 75 | SS-65 | 25 | — | — | 2.4 | Good | 1.13 |
| 75 | SS-C | 25 | — | — | 11.6 | Cracked | Cracked |
| 70 | SS-65 | 25 | — | 5 | 9.44 | Good | 1.74 |
| 70 | SS-C | 25 | — | 5 | 16.72 | Slight tendency to slump | 1.28 |
| 75 | SS-65 | 20 | 5 | — | 3.2 | Good | 1.85 |
| 75 | SS-C | 20 | 5 | — | 9.8 | Fair | 3.24 |
| 70 | SS-65 | 20 | 5 | 5 | 9.8 | Good | 1.98 |
| 70 | SS-C | 20 | 5 | 5 | 12.8 | Good | 2.44 |

[a]Determined by diametrical compression. Standard deviation ± 20%

The compostion containing SS-C sodium silicate absorbed substantially larger quantities of water than those containing SS-65 during curing in the higher humidity environment. As a result, the SS-C'specimens exhibited extensive cracking after curing. It is noted that the presence of either $Ca(OH)_2$ or salt or both inhibited cracking in the samples and improved the quality of the specimens. Samples containing SS-65 were of good quality and remained intact with or without $Ca(OH)_2$ and/salt in the mixture.

EXAMPLE II

Several of the cured silicate/sludge and silicate/sludge/$Ca(OH)_2$ shapes from Example I with and without 5 weight percent salt in the composition were heated to 800° C. to simulate exposure to a hot fire. Specimens containing salt did not show any visible changes after the heat treatment. Samples containing no salt exhibited a limited amount of cracking. This shows that the specimens, would be stable under hot-fire conditions.

EXAMPLE III

To determine solubility, the shapes from Example I were placed in room temprature static water for 15 days. Sodium silicate containing the higher silicate ratios, with and without $Ca(OH)_2$ were stable and showed no signs of weight loss. The shapes with the lower ratio of $SiO_2$ which also contained $Ca(OH)_2$ also remained stable and showed no weight loss while the samples without $Ca(OH)_2$ became soft and did not retain their strength. This made it evident that the water stability of the bodies depends on the $SiO_2$:$Na_2O$ ratio of silicate in the waste form.

EXAMPLE IV

The fracture strengths of several of the shapes were determined by diametrical compression. The results are given in Table II. Note that the samples prepared from compositions containing SS-65/sludge/$Ca(OH)_2$ were slightly stronger than the same mixture prepared without the $Ca(OH)_2$. The small difference in the strength indicates that the addition of silicate alone will provide adequate bonding between the waste particles by the formation of hydrated silicates and cementitious bonds due to reaction of one or more of the sludge components with the silicates. The data indicates that the presence of 5 weight percent salt did not significantly influence the mechanical strength.

EXAMPLE V

Several samples consisting of 75 weight percent sludge, 5 weight percent $Ca(OH)_2$ and 20 weight percent either SS-65 or SS-C were impacted and the percentage of fines, varying from 5.0 to 200.0 um were determined. The samples containing SS-65 generated an estimated amount of about 0.2 weight percent fines whereas those containing SS-C generated about 0.04 weight percent fines. In comparison, under similar impact conditions, the fused salt/sludge form generated about 0.1 weight percent fines and the sintered silicate/$Fe_2O_3$ system generated about 0.001 weight percent fines.

From the preceding Examples and discussion, it can be seen that the method of the invention provides an interim waste storage form for high-level radioactive waste. This waste form is easy and relatively inexpensive to prepare and results in a form which is insoluble, fire resistant and suitable for transportation and temporary storage of high-level radioactive wastes.

The embodiments of this invention in which an exclusive property or privilege is claimed are defined as follows:

1. A method of preparing a substantially water-insoluble solid product for the interim storage of dried nuclear wastes consisting essentially of:

mixing the dried wastes as a powder, with at least 10 weight percent powdered, anhydrous amorphous sodium silicate to form a mixture, the sodium silicate having a $SiO_2$:$Na_2O$ ratio of at least 2:1, subjecting the mixture to an environment having a relative humidity of at least 70%, a temperature from about room temperature up to about 35° C. for a period of time sufficient for the mixture to become saturated with moisture thereby curing the mixture and forming a substantially water-insoluble solid product.

2. The method of claim 1 wherein the dried wastes are calcines.

3. The method of claim 2 wherein the $SiO_2$:$Na_2O$ ratio is from 4.0:1 to 2.0:1 and the relative humidity is from about 70 to about 90%.

4. The method of claim 3 wherein the mixture also contains up to 10 weight percent calcium hydroxide.

5. The method of claim 4 wherein the mixture is cold pressed to form a green body having a density up to 60% of theoretical.

6. The method of claim 5 wherein the mixture contains about 25 weight pecent anhydrous sodium silicate, having a $SiO_2$:$Na_2O$ ratio of 3.22:1 and about 5 weight percent calcium hydroxide.

7. The method of claim 6 wherein the mixture also contains up to 10 weight percent of one or more sodium compounds selected from the group consisting of nitrates, nitrites and oxides.

8. A substantially water-insoluble solid for preventing the release of radioactive waste material consisting essentially of up to 90 weight percent powdered, dried radioactive nuclear wastes disposed in a matrix of silicate, with which it forms cementitious bonds, said solid being prepared by mixing dried radioactive nuclear waste powders with at least 10 weight percent powdered, anhydrous sodium silicate to form a mixture, the sodium silicate having a $SiO_2$:$Na_2O$ ratio of at least 2:1, and subjecting the mixture to an environment having a relative humidity of at least 70% at a temperature from about room temperature up to about 35° C. for a period of time sufficient for the mixture to become saturated with moisture thereby curing the mixture and forming the solid.

9. The solid of claim 8 wherein the dried radioactive nuclear wastes are calcines.

10. The solid of claim 9 wherein the matrix also contains up to 5 weight percent calcium hydroxide.

11. The solid of claim 10 wherein the matrix also contains up to 10 weight percent of one or more sodium compounds selected from the group consisting of nitrate, nitrite and oxide.

12. The solid of claim 11 wherein the sodium silicate has a $SiO_2$:$Na_2O$ ratio of 3.22:1.

* * * * *